US007878029B2

(12) United States Patent
Lonati et al.

(10) Patent No.: US 7,878,029 B2
(45) Date of Patent: Feb. 1, 2011

(54) CIRCULAR KNITTING MACHINE FOR SOCKS WITH NEEDLES ON THE DIAL

(75) Inventors: Ettore Lonati, Brescia (IT); Tiberio Lonati, Brescia (IT); Fausto Lonati, Brescia (IT)

(73) Assignee: Santoni S.p.A., Brescia (IT)

( * ) Notice: Subject to any disclaimer, the term of this patent is extended or adjusted under 35 U.S.C. 154(b) by 0 days.

(21) Appl. No.: 12/670,353

(22) PCT Filed: Jul. 15, 2008

(86) PCT No.: PCT/IT2008/000472

§ 371 (c)(1),
(2), (4) Date: Mar. 1, 2010

(87) PCT Pub. No.: WO2009/013773

PCT Pub. Date: Jan. 29, 2009

(65) Prior Publication Data

US 2010/0192637 A1 Aug. 5, 2010

(30) Foreign Application Priority Data

Jul. 24, 2007 (IT) ..... BS07A0104

(51) Int. Cl.
*D04B 15/02* (2006.01)

(52) U.S. Cl. ..... 66/149 S

(58) Field of Classification Search ..... 66/8, 66/140 R, 140 S, 17, 19, 28, 95
See application file for complete search history.

(56) References Cited

U.S. PATENT DOCUMENTS

| | | | | | |
|---|---|---|---|---|---|
| 3,516,268 | A | * | 6/1970 | Foreman | 66/149 S |
| 4,454,729 | A | * | 6/1984 | Lonati | 66/28 |
| 5,052,196 | A | * | 10/1991 | Turini | 66/149 S |
| 5,203,184 | A | * | 4/1993 | Lonati et al. | 66/95 |

FOREIGN PATENT DOCUMENTS

| | | |
|---|---|---|
| DE | 2117125 | 10/1971 |
| GB | 2121838 | 1/1984 |

* cited by examiner

*Primary Examiner*—Danny Worrell
(74) *Attorney, Agent, or Firm*—Shoemaker and Mattare

(57) ABSTRACT

A circular knitting machine for men's socks with needles on the dial comprising a dial needles selector mechanism able to selectively move the dial needles to involve the selected needles in the formation of the stitches and to exclude the needles not selected. In addition the machine is able to repeatedly perform transfer of the stitch from the cylinder to the dial. Moreover, the machine is fitted with a mechanical traction mechanism for tensioning the sock being formed. In addition, the machine presents expedients to limit the deformation of the selector rods and reduce detrimental effects on the actuator or flaws in the formation of the stitch.

28 Claims, 15 Drawing Sheets

CIRCULAR KNITTING MACHINE FOR SOCKS WITH NEEDLES ON THE DIAL

The present invention relates to a circular knitting machine for men's socks, of the type with needles on the dial.

As is known, circular knitting machines for men's socks can be divided into two main categories: those with single-cylinders and double cylinders.

The first have a simpler functioning system and lower production and maintenance costs, but cannot reproduce some types of stitch, unlike the double cylinder machines.

The single cylinder machine with needles on the dial performs a broader range of machining compared to the simple single cylinder machine, without however enabling all the types of machining possible with the double cylinder machine.

However there are some types of production, such as those involving the production of a knitted fabric with multicolour decorative patterns, which require cutting of the coloured yarns, only possible on the single cylinder machines, inasmuch as fitted with a cutter above the cylinder.

The purpose of the present invention is to create a circular knitting machine for men's socks, with needles on the dial, which makes it possible to perform a broader range of machining processes, overcoming the drawbacks mentioned while maintaining the advantageous aspects of this type of machine.

Such purpose is achieved by a single cylinder machine with needles on the dial, made according to claim 1. The dependent claims describe embodiment variations.

The characteristics and advantages of the machine according to the present invention will be evident from the description given below, made by way of an illustrative and non-limiting example, in accordance with the attached figures, wherein.

Figure 5:
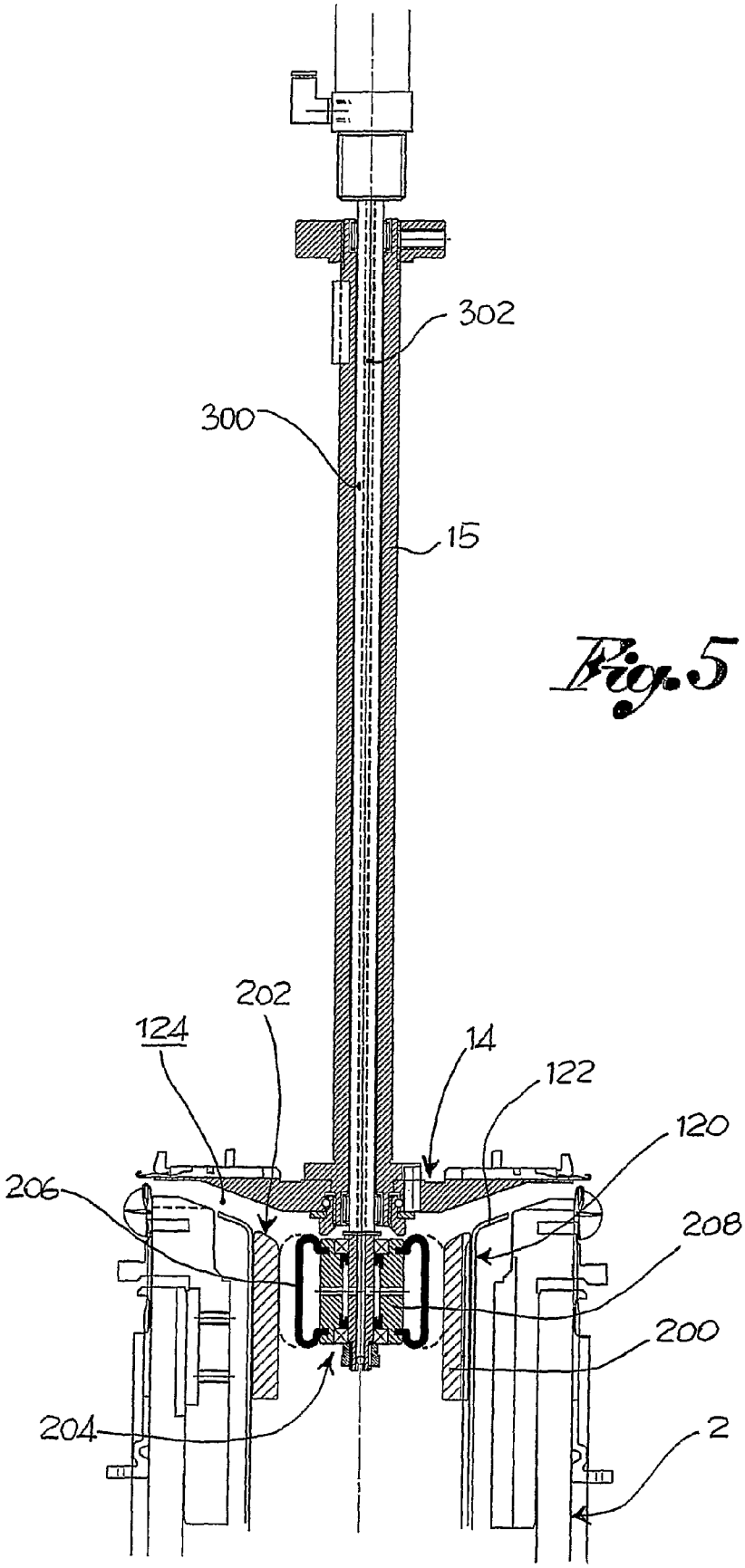
Figure 6A:
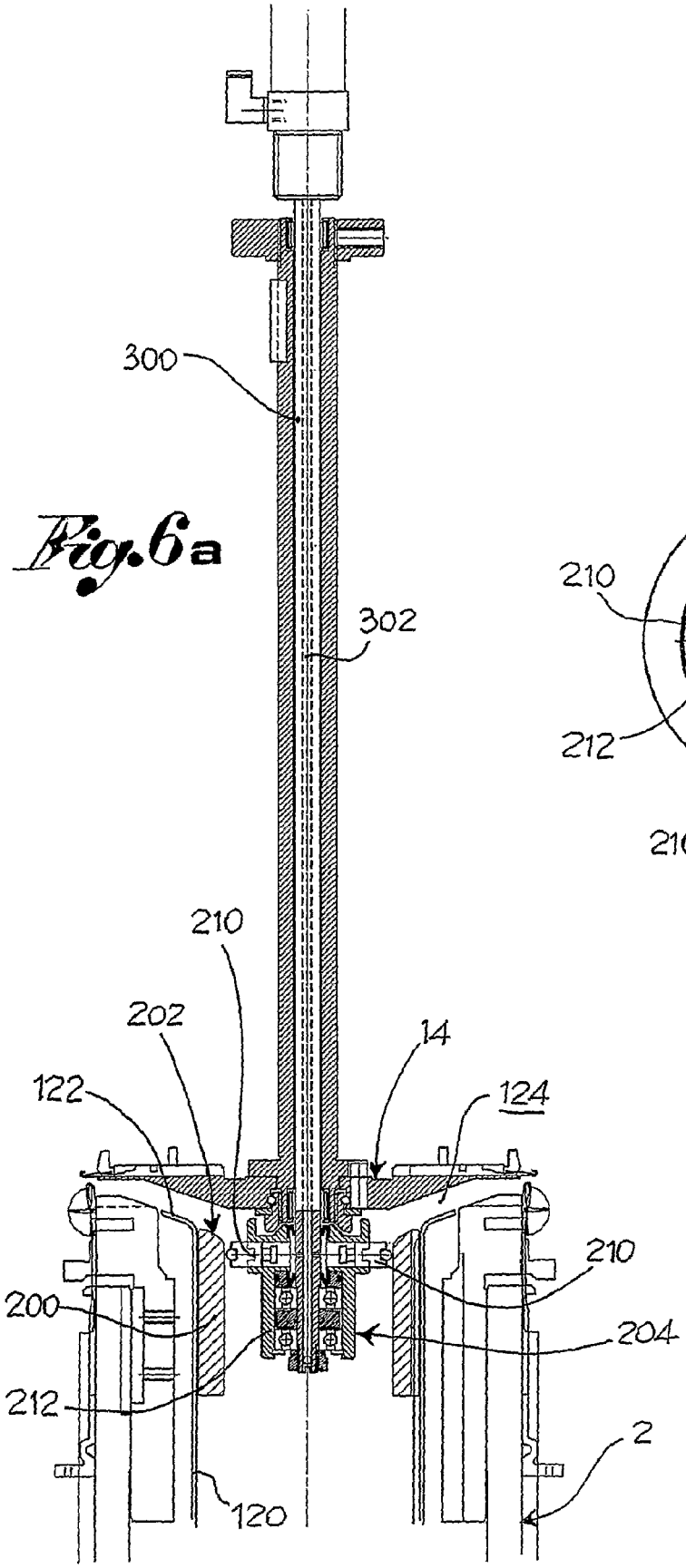
Figure 6B:
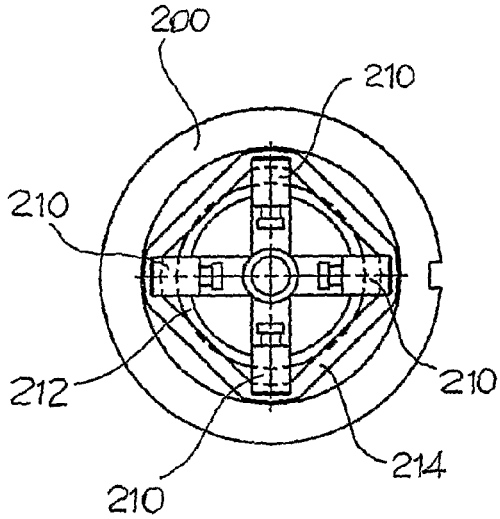

FIGS. 4*a* to 4*f* show a sequence of machine processes of the machine according to the present invention, in a further embodiment variation, able to repeatedly perform, during the production of a single sock, the transfer of the stitch from the cylinder to the dial;

FIGS. 5, 6*a* and 6*b* show further embodiment variations of the machine according to the present invention;

FIGS. 7*a* and 7*b*, 8, 9, 10*a* and 10*b*, 11*a* and 11*b* represent further embodiment variations of the machine according to the present invention.

With reference to the attached figures, reference numeral 1 globally denotes a circular knitting machine for the production of men's socks.

By the term "machine for men's socks", a type of machine for hosiery able to produce articles in which the proportion of the nominal diameter of the threads or yarns used to the dimensions of the stitch is such as to produce a knitted fabric with a high level of coverage, in other words with the opposite characteristic to the sheerness of traditional ladies' stockings. In other words, the wording "men's socks" refers in actual fact to an intrinsic characteristic of the article produced and not to the effective use made of the same.

The machine 1 comprises a cylinder 2, hollow on the inside, having a rotation axis X, rotating in a manner that can be controlled around said axis, and having a plurality of axial grooves on its external surface.

Furthermore, the machine 1 comprises a plurality of cylinder needles 6, held so that they can slide along the axial grooves 4 of the cylinder 2.

In addition, the machine 1 comprises a drum (not shown), coaxial to the cylinder 2 and situated externally to it, which can be made to rotate around the cylinder.

Furthermore, the machine 1 comprises a mechanism for moving the cylinder needles, able to impose translation in alternate directions on the cylinder needles 6 between a lower limit position and an upper limit position, axially higher than the lower limit position.

The movement mechanism comprises a plurality of cams, joined to the drum, fitted with active surfaces which, engaging sufficiently with the cylinder needles, cause it to rise and/or lower as needed.

Furthermore, the machine 1 comprises a fixed external crown 8, which surrounds the cylinder 2, coaxial with it, fitted with a plurality of crown grooves 10, positioned radially in relation to the rotation axis X.

The machine 1 comprises, in addition, a plurality of sinkers 12, held so that they can slide along the crown grooves 10 and relative mechanism for moving the sinkers, able to impose translation of the sinkers in alternate directions between a rearward limit position and a forward limit position, radially internal to the rearward limit position.

The machine 1 also comprises a dial 14, positioned so as to surmount the cylinder 2, coaxial with it and which can be made to rotate around the rotation axis X of the cylinder 2.

Specifically, the machine 1 comprises a dial shaft 15, which extends along the rotation axis X and surmounts the dial 14, joined to a lower extremity of said dial 14, so as to move it in rotation, and engaged with motorised means at the other extremity.

The dial 14 is fitted with a plurality of radial grooves 16, which extend radially, remaining inside the imaginary axial prolongation of the external surface of the cylinder 2, as well as a plurality of dial needles 18, for example in the same number as the cylinder needles, held so that they can slide along the radial grooves 16 of the dial 14.

Furthermore, the machine 1 comprises a mechanism for moving the dial needles, which can engage with said dial needles and able to impose a translation of the dial needles in alternate directions, between a rearward limit position and a forward limit position, radially external in relation to the rearward limit position.

For example, the machine 1 comprises an annular cover 20, positioned above the dial 14, coaxial with it and fixed; the mechanism for moving the dial needles comprises a plurality of cams 22, joined to the cover 20, so that, by turning the dial, said cams 22 engage the dial needles imposing their radial translation.

The machine 1 comprises in addition at least one yarn-finger (not shown) able to feed at least one yarn for the production of the sock.

The cylinder needles 6, the dial needles 18 and the sinkers 12 work together to interlace the yarn and form the stitches which constitute the sock.

Furthermore, the machine 1 comprises dial needle selectors able to selectively move the dial needles to translate them from a disengaged position to an engaged position, in which they can be engaged by said mechanism for moving the dial needles, involving the selected needles in the formation of the stitches and excluding the needles not selected.

In other words, the mechanism for moving the dial needles only has an active function when the dial needles, and specifically the heel of the same, are situated outside a predetermined radial position, defined engagement position; when the dial needles, that is the heel of such, are radially positioned inside said predetermined radial position however, the mechanism for moving the dial needles is inactive, in other words cannot engage the dial needles.

The dial needles selectors are able to selectively translate (that is only some or all) of the dial needles 18, so that the selected needles can be engaged by the mechanism for moving the dial needles.

According to a preferred embodiment, the selectors comprise a plurality of selector rods 30 oscillating upon command, which can engage with the dial needles 18 so as to select some of them.

Said rods 30, preferably in the same number as the number of the dial needles, surmount the cylinder 2 and the dial and are arranged in a ring around the rotation axis X of the cylinder 2.

Preferably, the rods 30 comprise an engagement section 32, terminating in an engagement extremity 32*a* which can engage with at least one of said dial needles 18.

The annular uptwister 20, positioned above the dial 14, has an aperture 20*a* used specifically by the engagement extremity 32 to extend as far as the dial needle, that is with the heel of the same.

Figure 1:
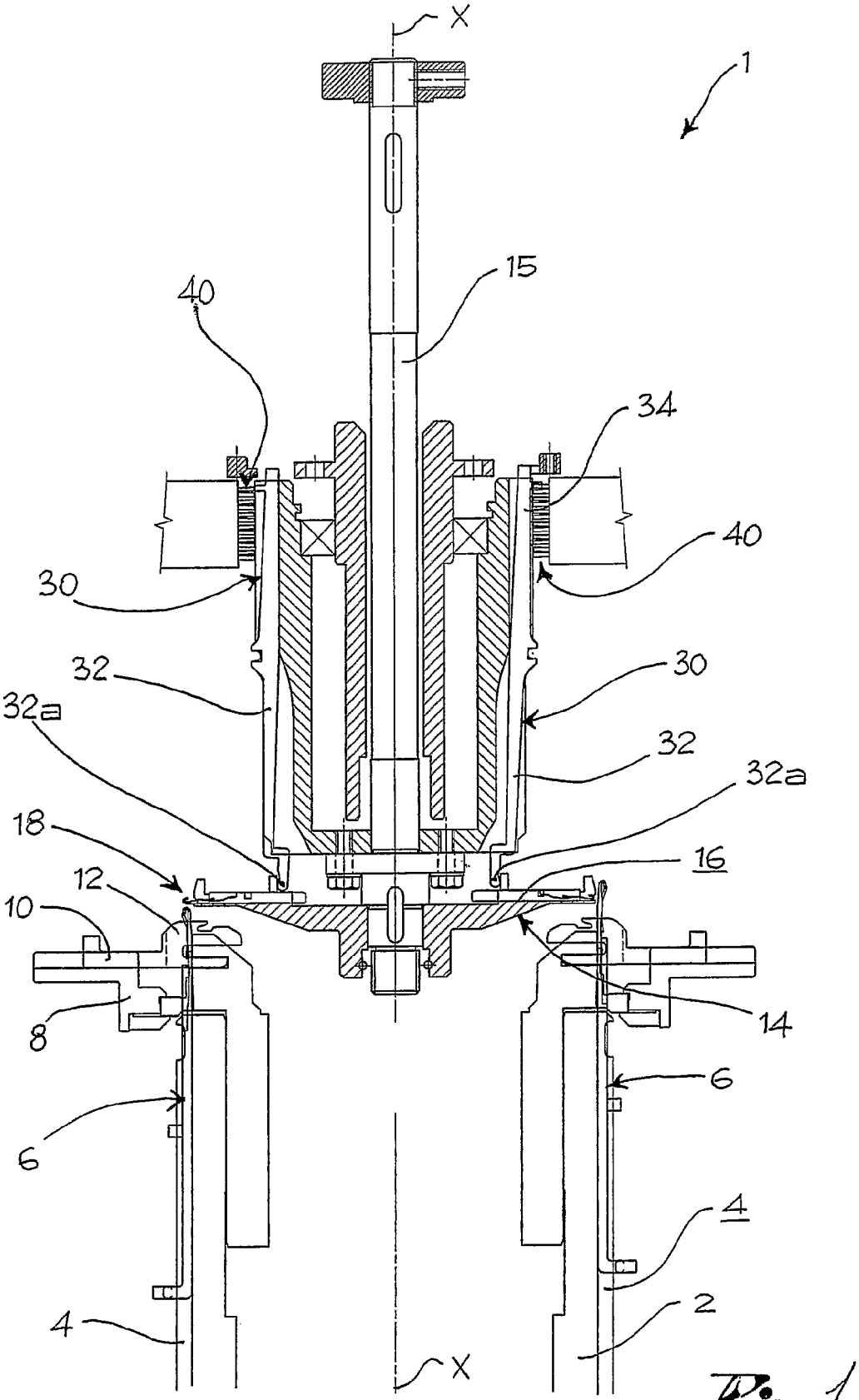
FIG. 1 shows a cross-section of a machine according to an embodiment variation of the present invention.
Figure 2:
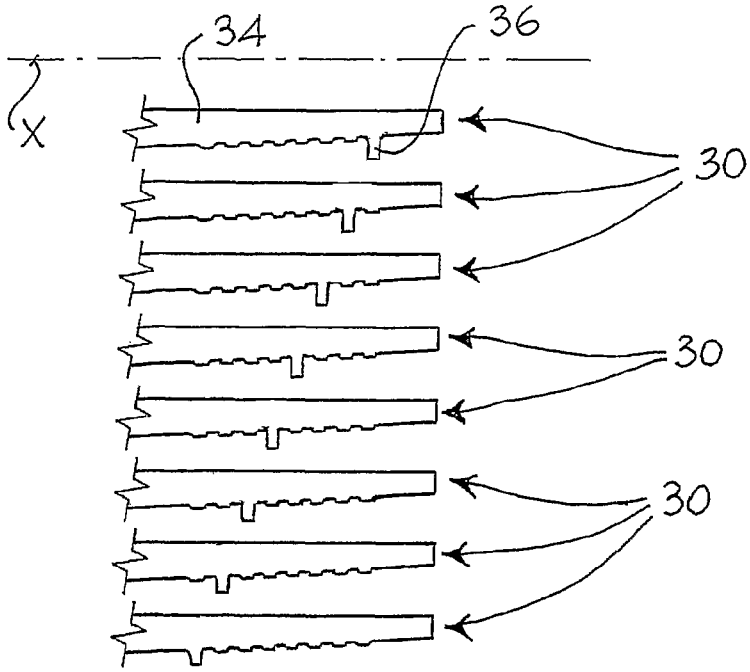
FIG. 2 shows a representative diagram of the extremities of the selector rods of the machine in FIG. 1.
Figure 3:
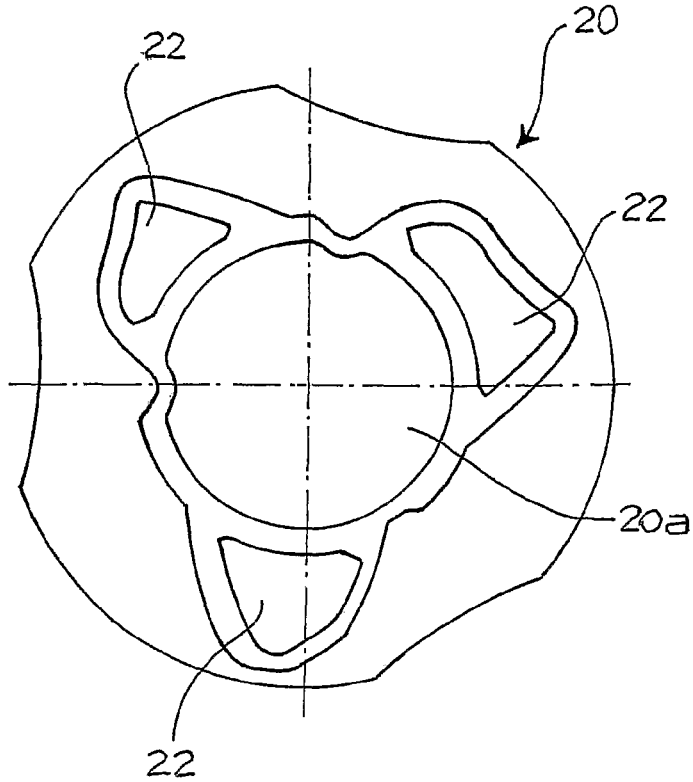
FIG. 3 shows a view of an uptwister of the machine in FIG. 1, comprising a mechanism for moving the dial needles.

Furthermore, the rod 30 comprises a command section 34, connected to the engagement section 32. The command section 34 of each rod 30 comprises a boss 36 projecting externally in relation to the rotation axis X of the cylinder 2; the bosses 36 of the rods 30, when compared to each other, are reciprocally staggered, for example axially (FIG. 2).

Preferably, in addition, the selectors comprise selection command devices able to selectively move at least one of said rods 30, so as to select the corresponding dial needle.

For example, the selection command devices comprise a plurality of actuator levers 40, which can be selectively commanded to protrude, axially staggered like the bosses 36 of the levers 30, engaging the boss 36 of one of said rods 30, to make it oscillate and select the respective dial needle.

Preferably, in addition, the dial needles 18 comprise a machining section for the creation of the stitch and a moving section, which can engage with the mechanism for moving the dial needles.

According to one embodiment variation, the moving sections of the dial needles are staggered axially, for example at two different heights, so as to enable the radial arrangement on the dial of a number of dial needles the same as the number of cylinder needles.

Preferably, in addition, the machine 1 comprises a cutting device, positioned on the uptwister 20, able to cut the yarn.

According to a further embodiment variation, the cylinder needles 6 comprise a) a spindle 50 extending mainly along the rotation axis X, between a lower extremity 50*a* (heel), which can be influenced by the mechanism for moving the cylinder needles, and an upper extremity 50*b*, which can engage with the dial needles 18 and the sinkers 12 to form the stitch;

b) a hook and a tab at the upper extremity 50*b* of the spindle; the tab is pivoted on the spindle 50 at a hinging point, so as to be reclosable onto the hook to form the space for the yarn;

c) a transfer boss 60, projecting externally from the spindle 50, positioned below the hinging point of the tab, able to engage a stitch in the movement between a lower limit position and an upper limit position.

The transfer boss 60 is positioned along the spindle 50 in such a way that, in the upper limit position of the cylinder needle, said transfer boss is above the machining extremity of the dial needle 18 (FIG. 4*d*), to enable the transfer of the stitch from the cylinder 2 to the dial 14.

Preferably, the cylinder needle 6 has a first heel 50*b*, at the lower extremity of the spindle, and a second heel 50*c*, between the first heel 50*b* and the transfer boss 60, able to be engaged by the mechanism for moving the cylinder needles to bring the cylinder needle 6 to the upper limit position, and raise it to an optimal position for the transfer of the stitch from the cylinder needle to the dial needle.

Preferably, in addition, the mechanism for moving the cylinder needles comprises at least one jack, positioned in the respective axial groove 4 of the cylinder 2, below the respective cylinder needle 6.

Specifically, according to a variation of the invention illustrated, the mechanism for moving the cylinder needles comprises two jacks 70, 80 positioned in the same axial groove 4 of the cylinder 2, one below the other.

Figure 4A:
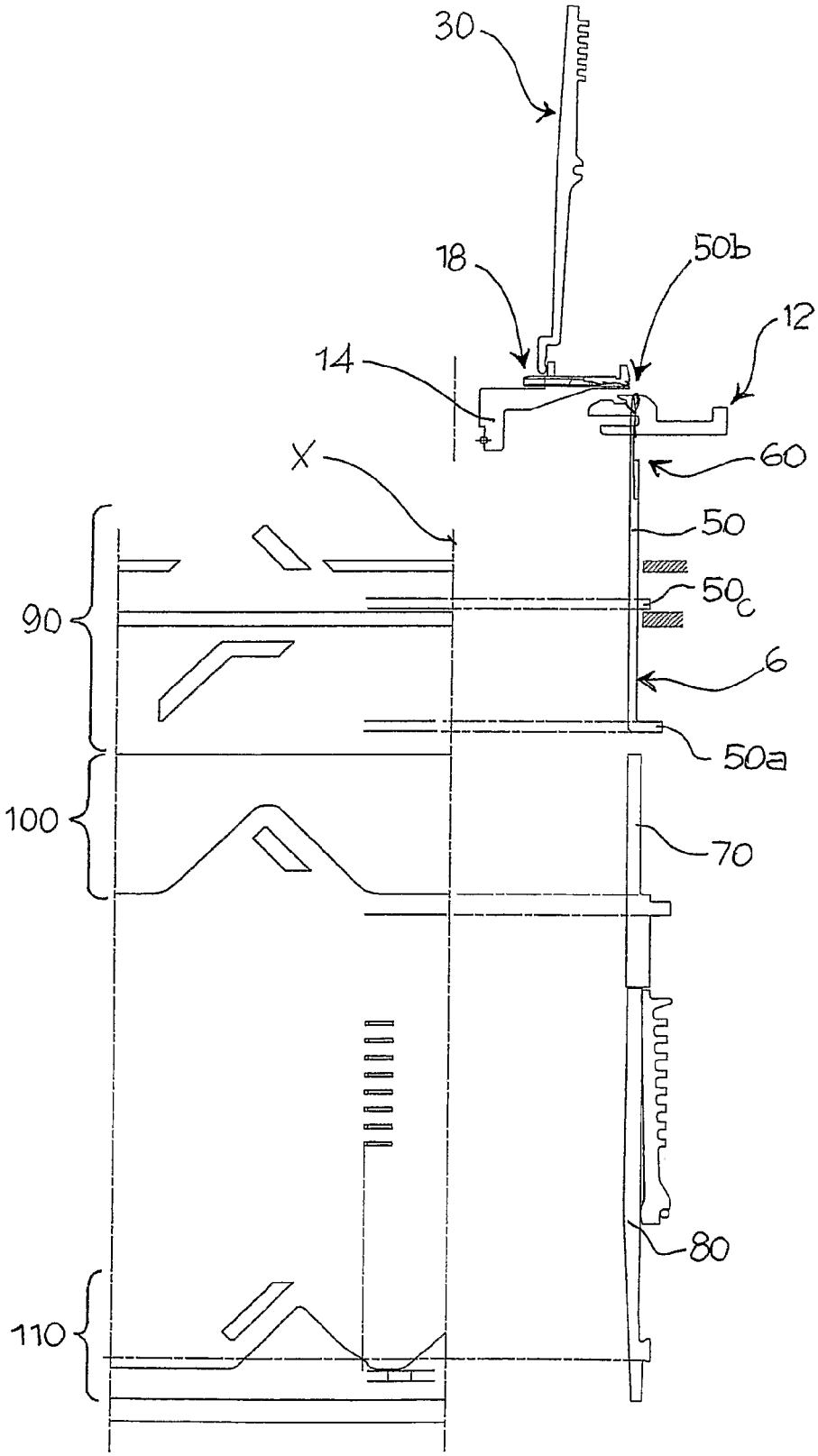
Figure 4B:
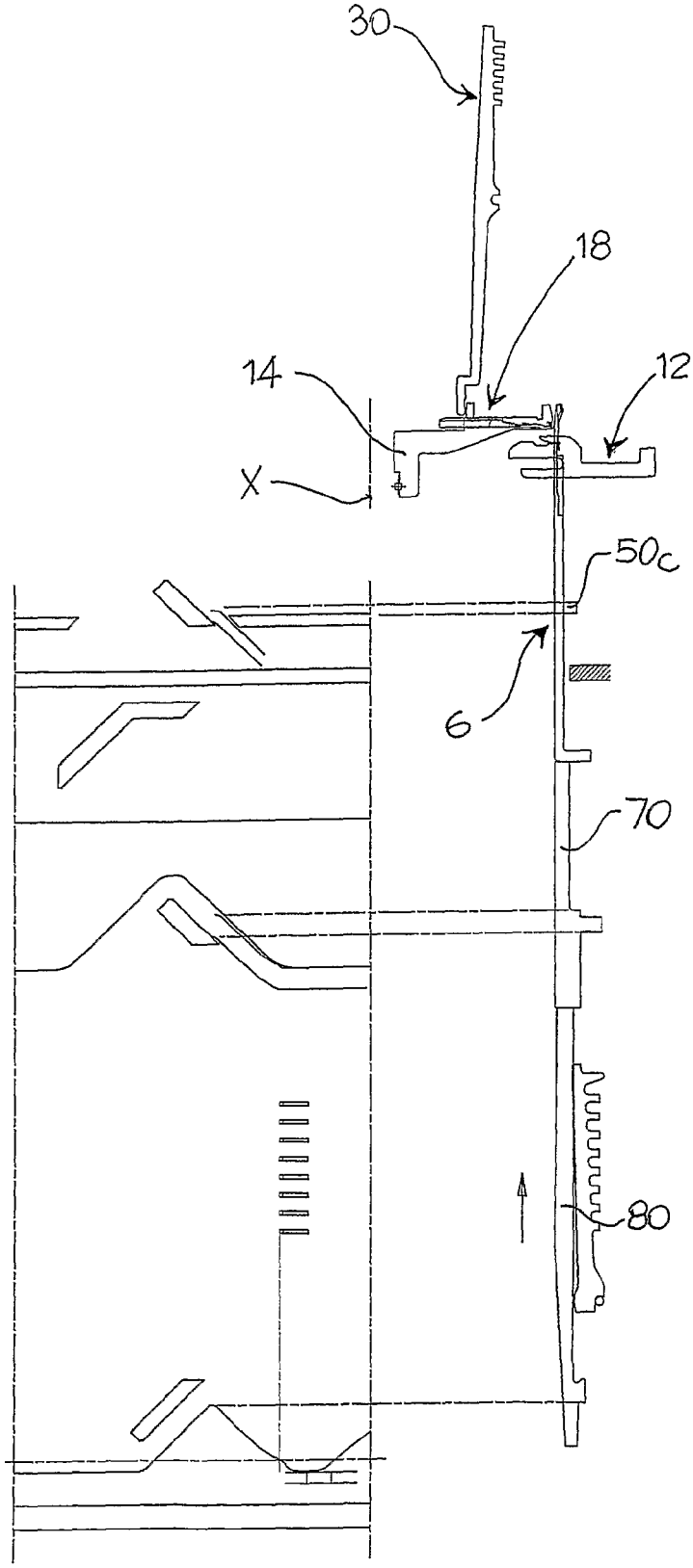
Figure 4C:
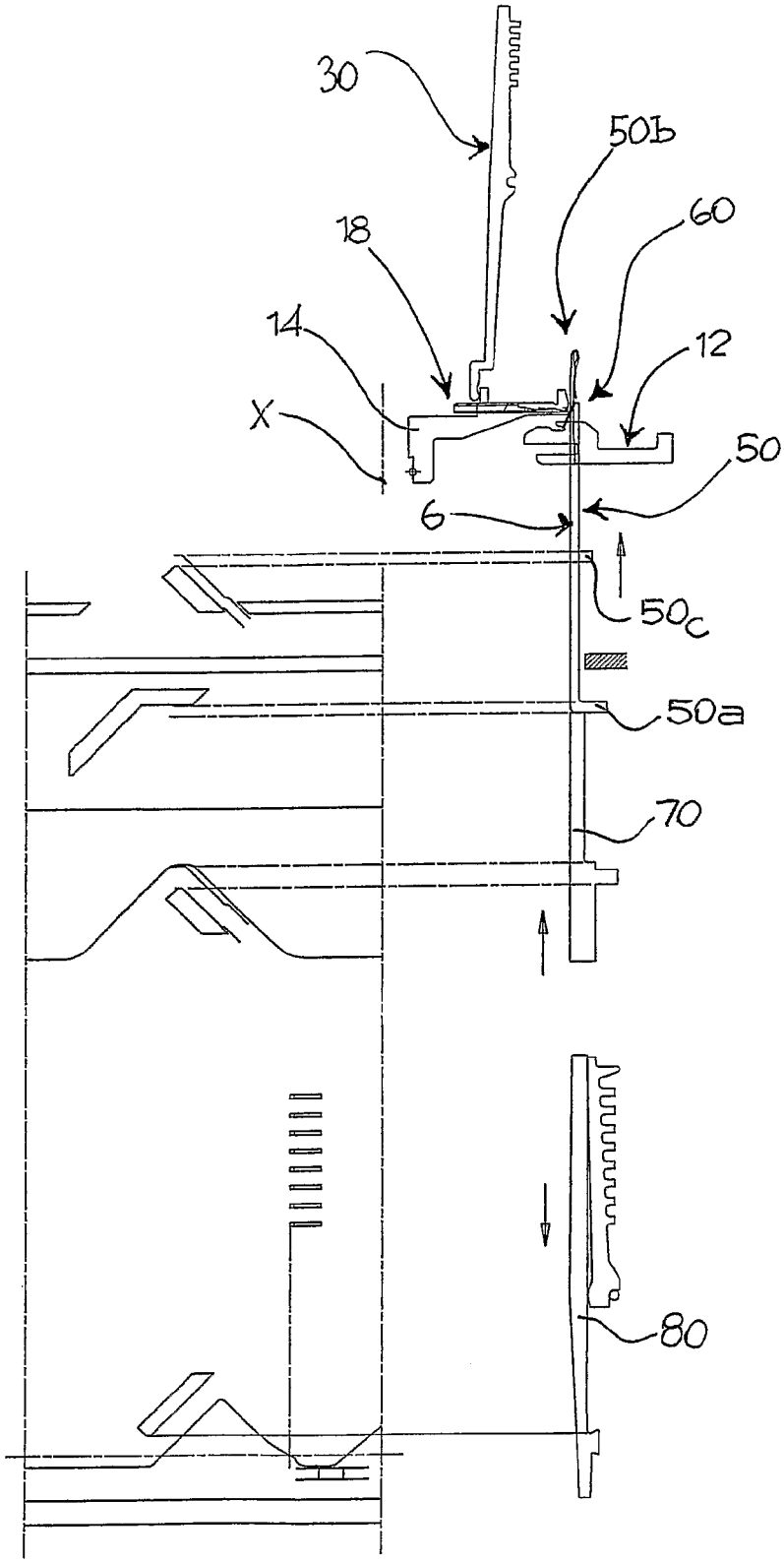
Figure 4D:
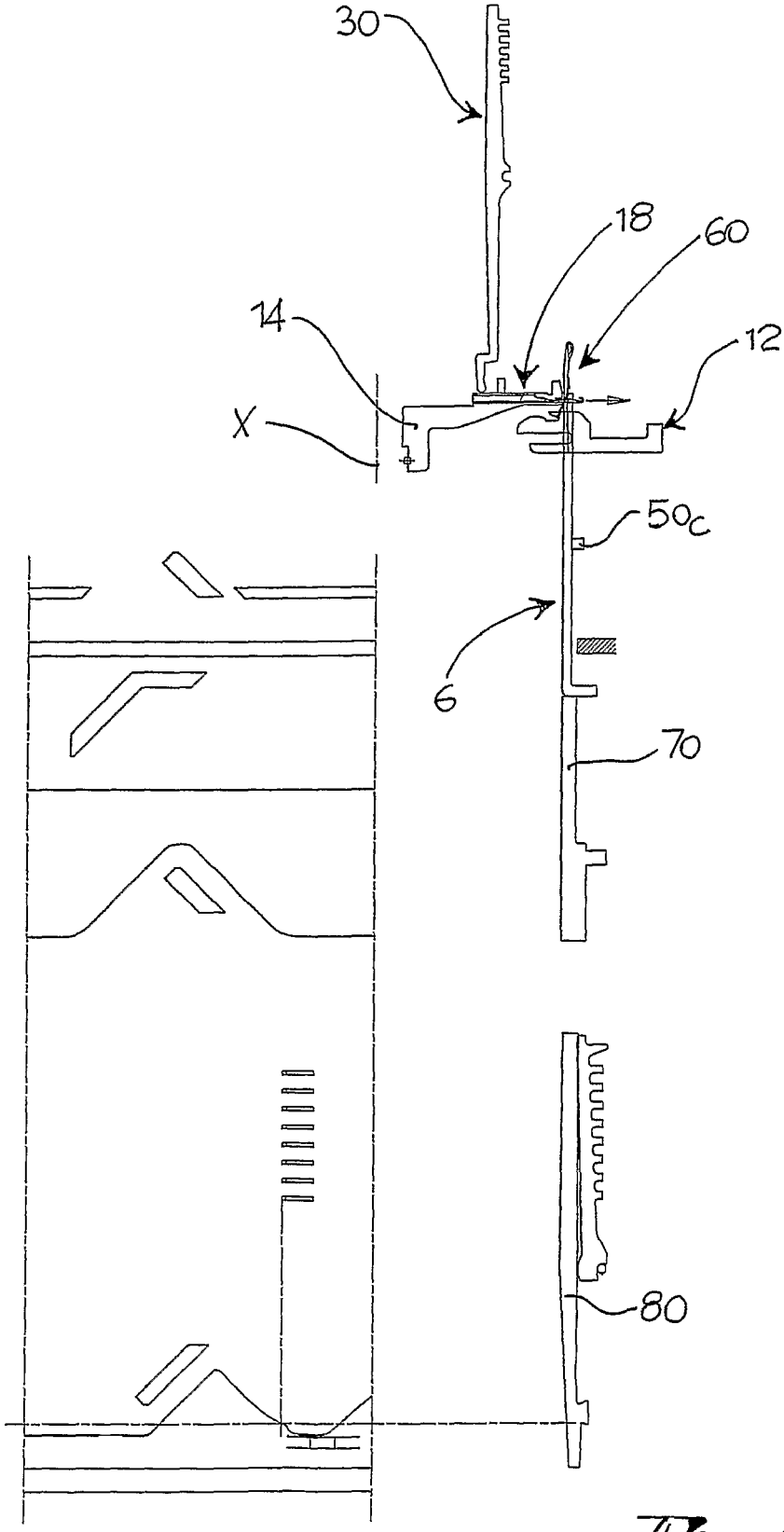
Figure 4E:
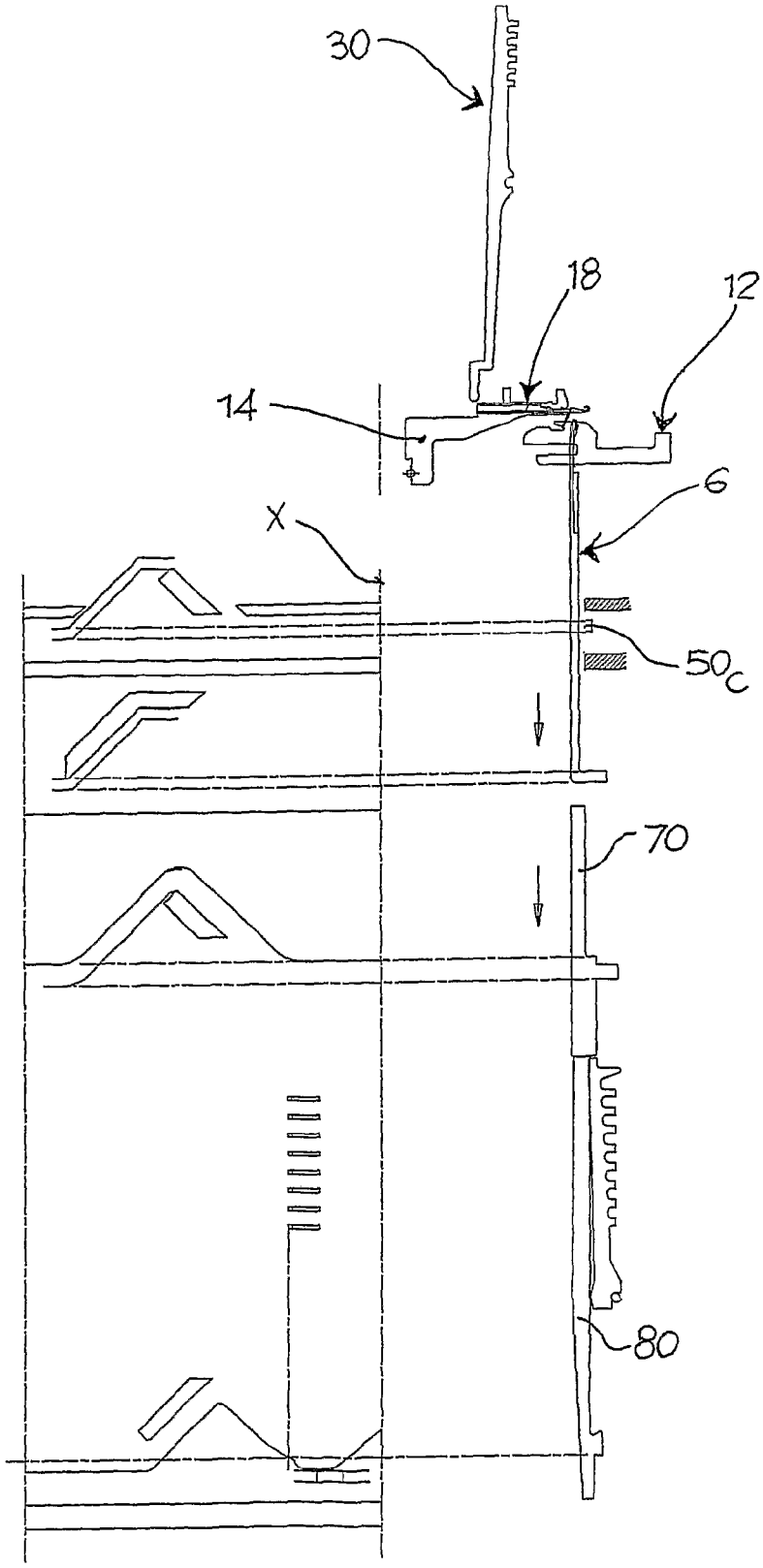
Figure 4F:
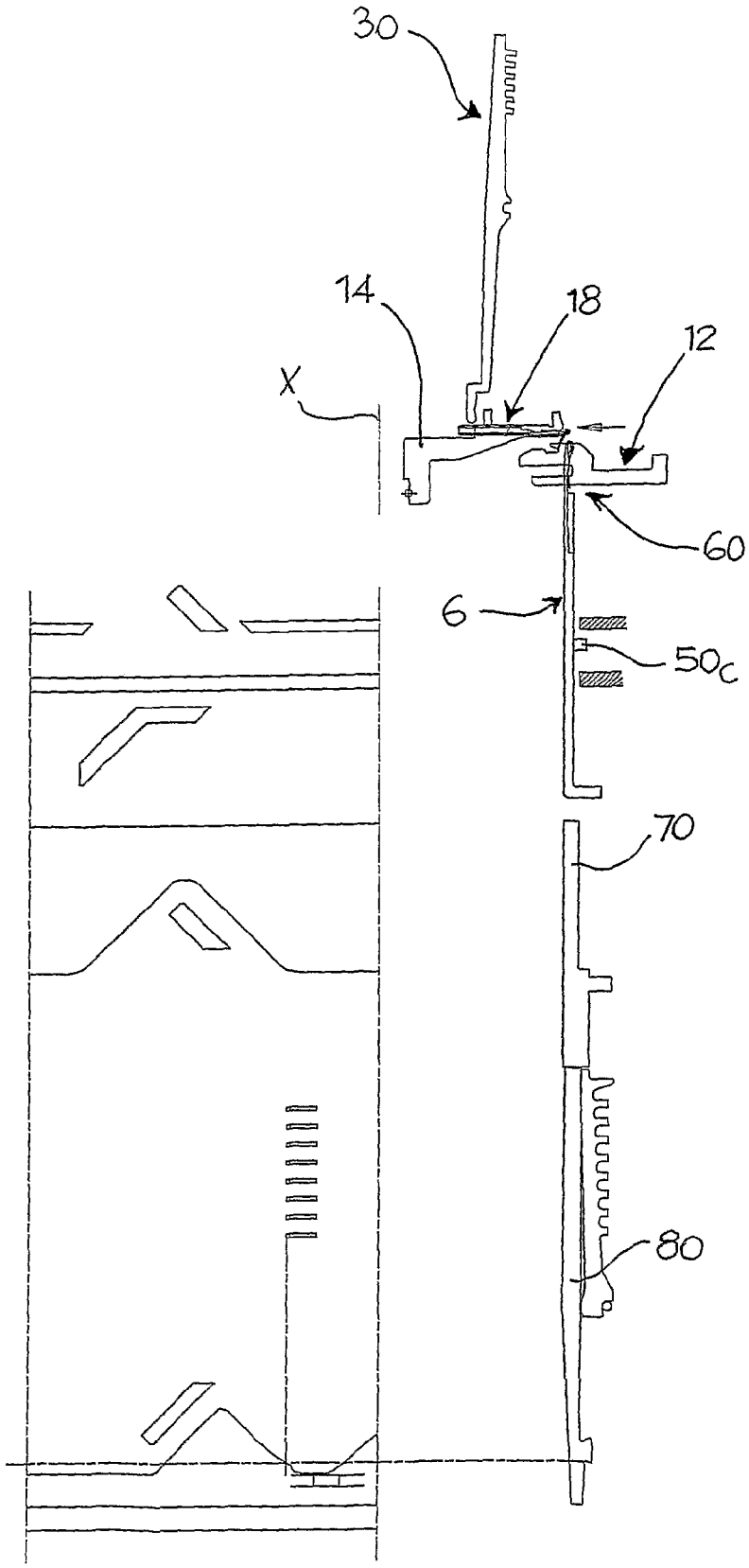

In addition, the mechanism for moving the cylinder needles comprises a plurality of cam units, joined to the drum, in which a first unit 90 is able to engage the cylinder needles 6 only for translation and further units 100, 110 are able to engage the respective jacks 70, 80 for translation (FIG. 4*a*).

According to an embodiment variation, the mechanism for moving the cylinder needles comprises an extremely steep cam which enables raising of the cylinder needle up to the position for transfer of the stitch from the cylinder to the dial.

Preferably, moreover, the machine 1 comprises suction means of traction, able to exert a pulling effect on the sock being formed, by means of a flow of air sucked inside the cylinder 2, which is hollow, from the top of it, where the dial is positioned, towards the bottom.

Specifically, the suction means of traction comprise a suction tube 120, inserted inside the cylinder 2, rotating jointly with the cylinder 2 itself. The tube 120 extends from the top of the cylinder 2, just below the dial 14, to the bottom of said cylinder.

Specifically, the tube 120 has an upper extremity 122 folded back externally onto the wall of the cylinder 2, so as to form a conical wall; said upper extremity 122, together with the bottom of the dial 14, also shaped as a truncated cone and axially distanced from the upper extremity 122 of the tube 120, form an annular entrance channel 124, from which the sock being made enters the tube 120, facilitated by the suction of the air.

According to one embodiment variation, the machine 1 comprises mechanical means of traction, able to exert a pulling effect on the sock being formed by mechanical gripping of the sock being formed and pulling towards the bottom of the cylinder 2.

In other words, said mechanical means of traction are able to mechanically pinch the sock being formed and pull it towards the bottom of the cylinder, keeping it taut as required.

The mechanical means of traction comprise one tubular bush 200, positioned inside the suction tube 120, rotating jointly with the tube 120 (which rotates jointly with the cylinder 2), but sliding axially in it.

For example, the bush 200 is attached to the tube 120 by means of a tab positioned externally to the bush, engaging with the tube 120. The construction embodiment of the tab is such as to drag the bush 200 in rotation, but to leave it axially free to slide inside the tube 120.

The bush 200 is therefore able to slide from an upper limit position to a lower limit position.

Preferably, moreover, the portion of upper extremity of the bush 200 is shaped by means of a truncated cone shaped surface 202, so that when the bush is in the upper limit position, said surface 202 forms a prolongation of the channel 124 free of any obstacles to the descent of the sock being formed towards the inside of the bush.

Specifically, the shaped surface 202 is positioned mainly on the ideal prolongation of the extremity 122 of the tube 120.

In addition, preferably, the mechanical means of traction comprise a mechanism for Moving the bush (not shown), able to move the bush 200 between the upper limit position and the lower limit position and vice versa.

For example, the mechanism for moving the bush comprises a cylinder-piston system, preferably pneumatic.

The means of mechanical traction also comprise a gripping device 204, translatable inside the suction tube and which can be made to form mobile gripping elements so as to drag at least a portion of the sock being formed against the bush 200, to form a mechanical grip of the same.

According to one embodiment, the gripping device 204 comprises a flexible, inflatable, annular wall 206, positioned inside the bush 200, and a support body 208, to which the flexible wall 206 is connected in an airtight manner (FIG. 5).

The flexible wall 206 is inflatable so that, expanding, it forms a gripping element, solely in this case, which pushes a portion of the sock being formed against the bush 200, pinching it.

According to a further embodiment, the gripping device 204 comprises a plurality of sliding pistons 210, and a support body 212, in which the pistons 210 slide radially (FIGS. 6*a* and 6*b*).

The pistons 210 slide so that, coming out of the support body 212, they form gripping elements which press a portion of the sock being formed against the bush 00, pinching it.

Preferably, the gripping device 204 comprises means of return for the automatic return of the pistons from the forward position, in which they engage with the bush pinch the portion of sock being formed, to the rearward position.

For example, the return mechanism comprises an elastic element 214, concentric to the pistons, which engages the heads of the same.

Furthermore, the mechanical means of traction comprise a spindle 300, inside the dial shaft 15, sliding axially and separate in rotation from it, connected at the bottom to the gripping device 204, or to the support body 208, 212 of the same.

Specifically, the gripping device 204 is gyrates jointly with the spindle 300, by means of special bearings, in that the spindle, during the production of the sock, lacks rotation around the rotation axis X, while the gripping device 204 turns around the rotation axis X, to accommodate the natural rotation of the sock being formed and of the bush 200.

Preferably, the mechanical means of traction comprise a pair of position sensors, able to emit a position signal respectively when the spindle 300 is in the upper limit position, corresponding to the upper limit position of the gripping device 204, and when the spindle 300 is in the lower limit position, corresponding to the lower limit position of the gripping device 204.

Preferably the spindle 300, is fitted with an air supply channel 302, for example consisting of an axial hole, for the supply of pressurised air to the gripping device 204, and specifically to the support body 208, 212 of the same, for the inflation of the flexible wall 206 or the movement of the pistons 210 from the rearward position to the forward pinching position.

Said spindle perforated for the air supply constitutes an example of embodiment of the air supply mechanism, able to supply pressurised air to the gripping device 204; for example, alternatively, said air supply mechanism comprises flexible tubes connected to the gripping device 204.

According to a preferred embodiment, the suction traction mechanism is operatively connected to the mechanical traction mechanism, so as to produce synchronised functioning Specifically, during normal functioning of the machine, in an initial configuration corresponding to the beginning of the production of a sock, that is to the formation of the ankle band, the bush 200 is in the upper limit position, brought there by the mechanism for moving the bush. The gripping device 204 is in the upper limit position, brought there by the spindle 300, and is therefore inside the bush 200.

Once the production process of the sock has begun and the air traction mechanism activated the portion of sock already formed proceeds through the channel 124 inside the bush 200, sucked down by the air flow.

A portion of sock of a determined length, less than the length of the ankle band, having been formed, positioned between the gripping device 204 and the bush 200, the mechanical traction mechanism is activated.

Specifically, pressurised air is sent through the spindle 300.

Depending on the variation, the flexible wall 206 expands and pinches the portion of the sock already formed against the bush 200, forming a mechanical restraint, or the pistons 210 translate outwards, pinching the portion of the sock already formed against the bush 200.

The air traction mechanism is deactivated and the mechanism for moving the bush takes up the lower limit position.

Proceeding with the production of the sock, the gripping device 204, moved by the spindle 300, translates downwards, dragging the bush 200 with it.

This way, it is possible to make a portion of sock of a length at least equal to the available stroke of the spindle 300.

When the spindle 300 reaches the lower limit position:

depending on the position signal generated by the aforesaid sensors, the suction traction mechanism is reactivated;

the elements forming the stitch are stopped;

the air supply mechanism is deactivated so that the flexible wall deflates or the pistons return to a rearward position;

the gripping device 204 is brought back to the upper limit position by the spindle 300 and the bush 200 is brought back to the upper limit position by the mechanism for moving the bush;

the air supply mechanism is reactivated, so that the flexible wall inflates or the pistons return to a forward position, pinching the sock being formed against the bush again;

the suction traction mechanism is deactivated;

the elements forming the stitch are restarted, so that the production of the sock recommences.

Clearly this method of functioning is useful in those cases in which the length of the leg, the back and the toe of the sock is longer than the effective stroke of the spindle 300.

Innovatively, the machine according to the present invention makes it possible to include or exclude some of the dial needles from the stitch formation process, significantly increasing the range of machining possible.

Advantageously, moreover, the machine according to the present invention makes it possible to perform stitch formation processes with transfer of the stitch from the cylinder to the dial and vice versa, even repeatedly during the production of a single sock, as required.

According to such advantageous aspect, the mechanism for moving the cylinder needles makes it possible to obviate the problem of axial space needed to raise the cylinder needle to the optimal height for the transfer of the stitch from the cylinder needle to the dial needle.

As may be imagined, the machine according to the present invention is able to perform a range of machining so broad as to include those types performed by double cylinder machines.

Advantageously, moreover, the machine according to the present invention makes it possible to pull the sock being formed harder than in the current known single cylinder machines for men's socks, so as to keep the sock taut even in the presence of machining of the stitch which would tend to wrinkle it.

Figure 7A:
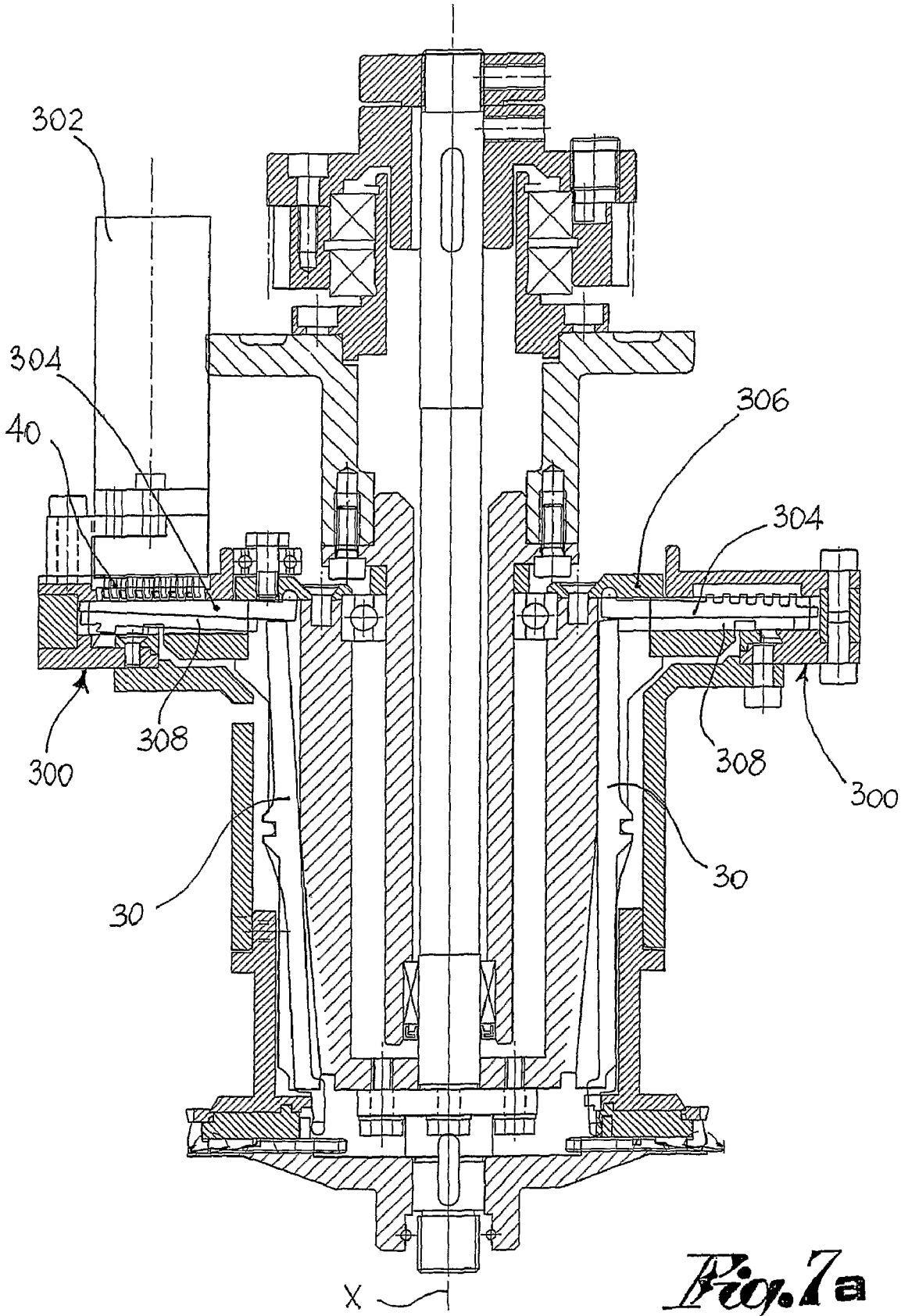
Figure 7B:
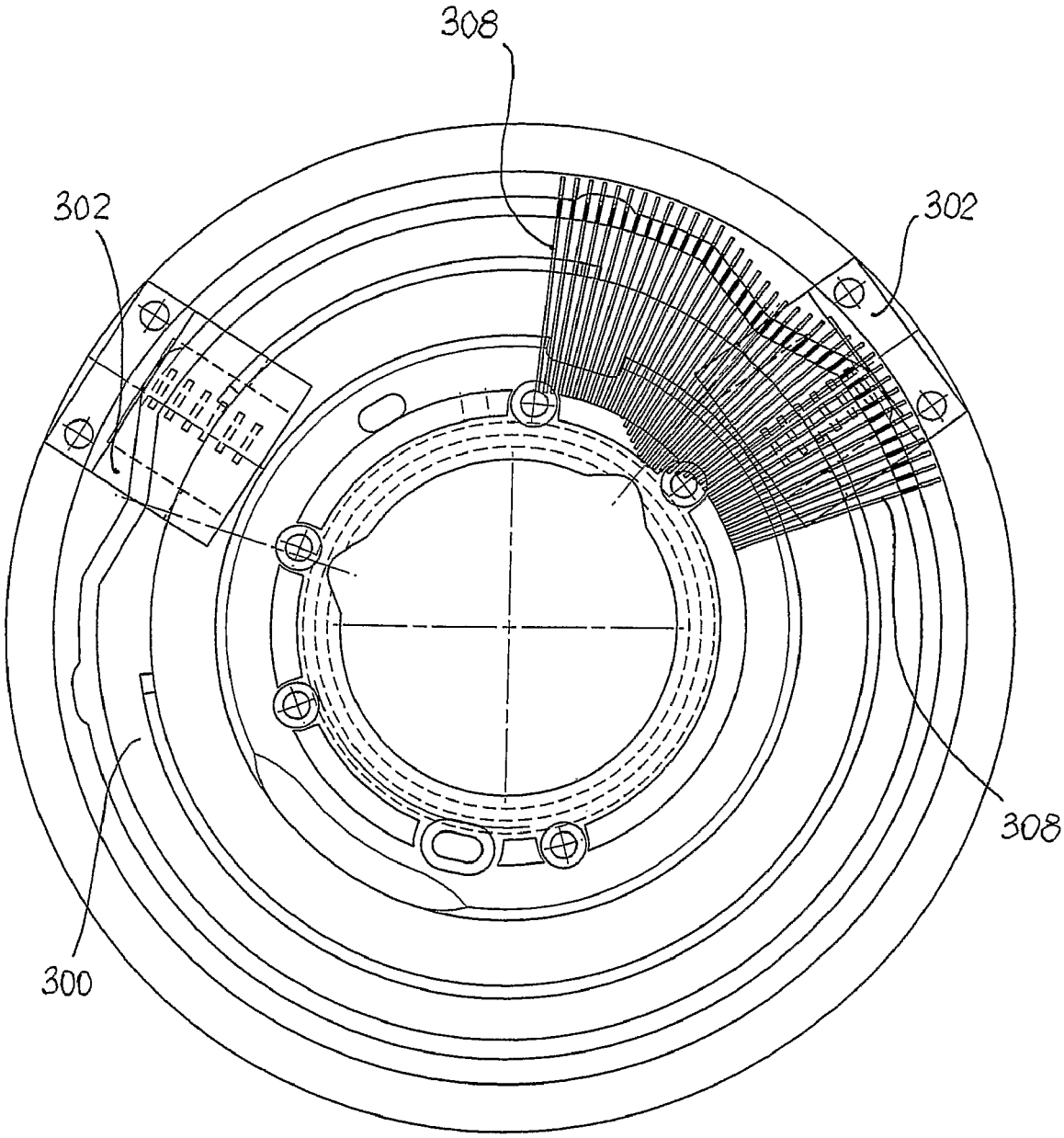

According to a further embodiment variation, the dial needle selectors comprise an intermediate selector cam 300 between the selection rod 30 and the selection command mechanism, for example an actuator 302 fitted with actuator levers 40 (FIGS. 7*a* and 7*b*).

In addition, the selectors comprise a plurality of intermediate selection levers 304, one for each selection rod 30, arranged radially, for example externally to the selection rods 30.

Preferably, the intermediate selection levers 304 are spring-hinged to a crown 306, so as to be oscillating and abut the respective actuator lever 40 of the actuator 302.

Moreover, the selectors comprise a plurality of thrust levers 308, one for each selector rod 304.

The thrust levers are mobile 308 and, specifically, oscillate between an engagement position, able to engage the cam 300, and a disengagement position.

The thrust levers 308, moreover, slide radially in relation to the respective intermediate lever 304, between an active position in which they operate on the respective selector rod 30, and a passive position.

Depending on the command of the actuator 302, some actuator levers 40 operate on the respective intermediate levers 304, lowering them, so as to lower the corresponding thrust lever 308, which moves into the engagement position, able to be influenced by the selector cam 300.

By rotating the cam 300, the thrust levers 308 selected, in other words, those lowered, are thrust radially, acting on the respective selector rod, which in turn oscillates, selecting the dial needle 18 desired.

The actuator 302 has an actuation axis parallel to the rotation axis X of the cylinder 2, that is, vertical axis.

Advantageously, the action needed to move the selector rod 30 so as to select the desired dial needle 18 does not operate as is on the actuator levers 40 of the actuator 302, in that the cam 30 radially abuts such action and slide in relation to the respective intermediate selection rod 304, while the actuator levers 40 move axially.

In other words, the selector cam 300, when it engages the thrust rod 308, radially abuts the action of the selector rod 30.

Advantageously, the structure is reliable given the limited strain on the actuator and high level of repeatability of the movements.

According to yet a further embodiment variation, the selector rod 30 is divided into at least three separate sections positioned with a mainly axial extension (FIG. 8), which can engage with each other.

Specifically, the selector rod 30 comprises an upper section 320, spring-hinged and oscillating under the effect of the actuator levers 40 of the actuator 302, an intermediate section 322 shifting radially under the effect of the upper section, and a final section, spring-hinged and oscillating under the effect of the intermediate section.

The actuator 302 has an actuation axis Y incident to the rotation axis X, for example perpendicular to it, that is horizontal.

The selectors comprise, in addition, a selector cam 326, positioned radially externally to the selector rod 30, so as to engage the intermediate section 322 all along the axial shift of it.

Depending on the actuator command, some actuator levers 40 operate on the respective selector rods 30, and specifically on the upper section 320 of these, making them complete an oscillation. Following the oscillation, the intermediate section 322 shifts radially, taking up a position suitable for being engaged by the selector cam 326.

Upon rotation of the cam, some intermediate sections 326 are engaged by it and forced to translate axially, towards the final section 324 of the selector rods 30.

The intermediate section, engaging the final section, causes it to oscillate, and therefore act on the desired dial needle 18.

The axial movement operating on the intermediate section 322 to keep the desired dial needle in position is released onto the cam 326, which acts as an axial abutment to such action, when it engages the intermediate section.

Advantageously, the structure is reliable given the limited strain on the actuator and high level of repeatability of the movements.

Advantageously, moreover, the final section is of limited size and therefore subject to limited deformation which could otherwise compromise the precise movement of the dial needles.

Figure 9:
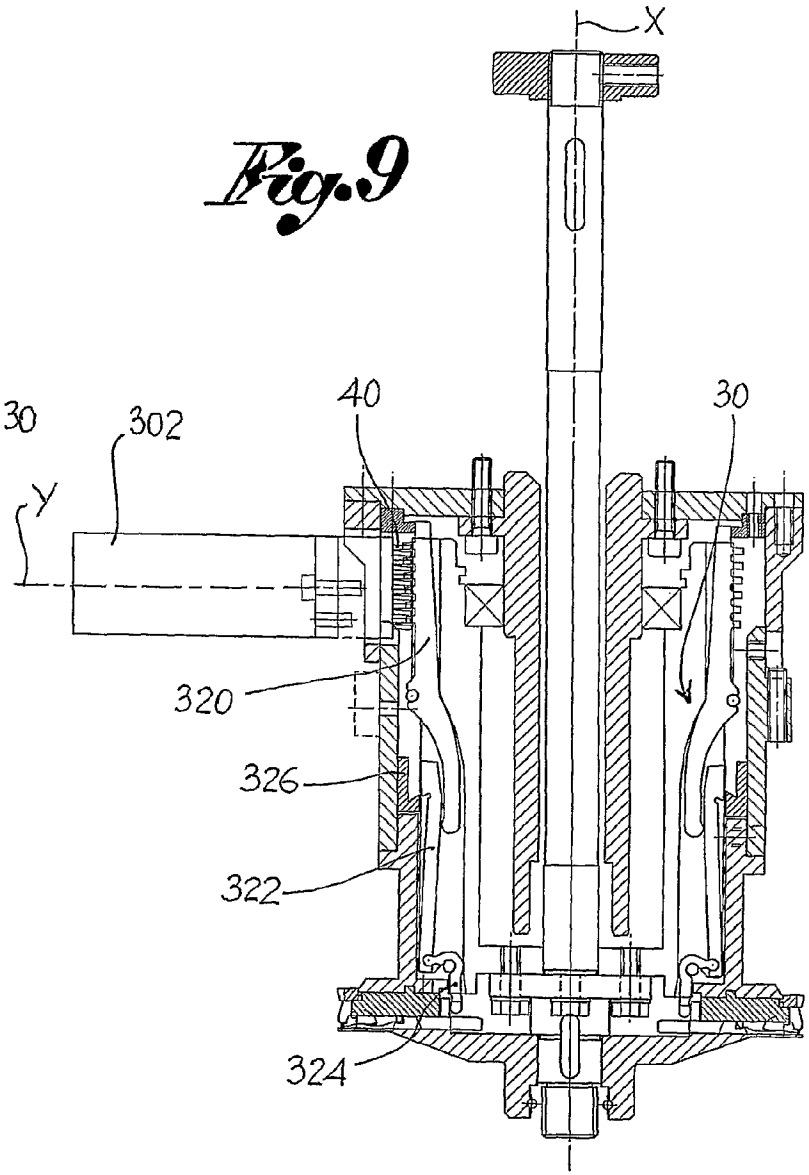

According to a further embodiment variation, the selectors comprise a selector rod 30 in three separate sections, in which the intermediate section is hinged to the final section (FIG. 9).

Figure 8:
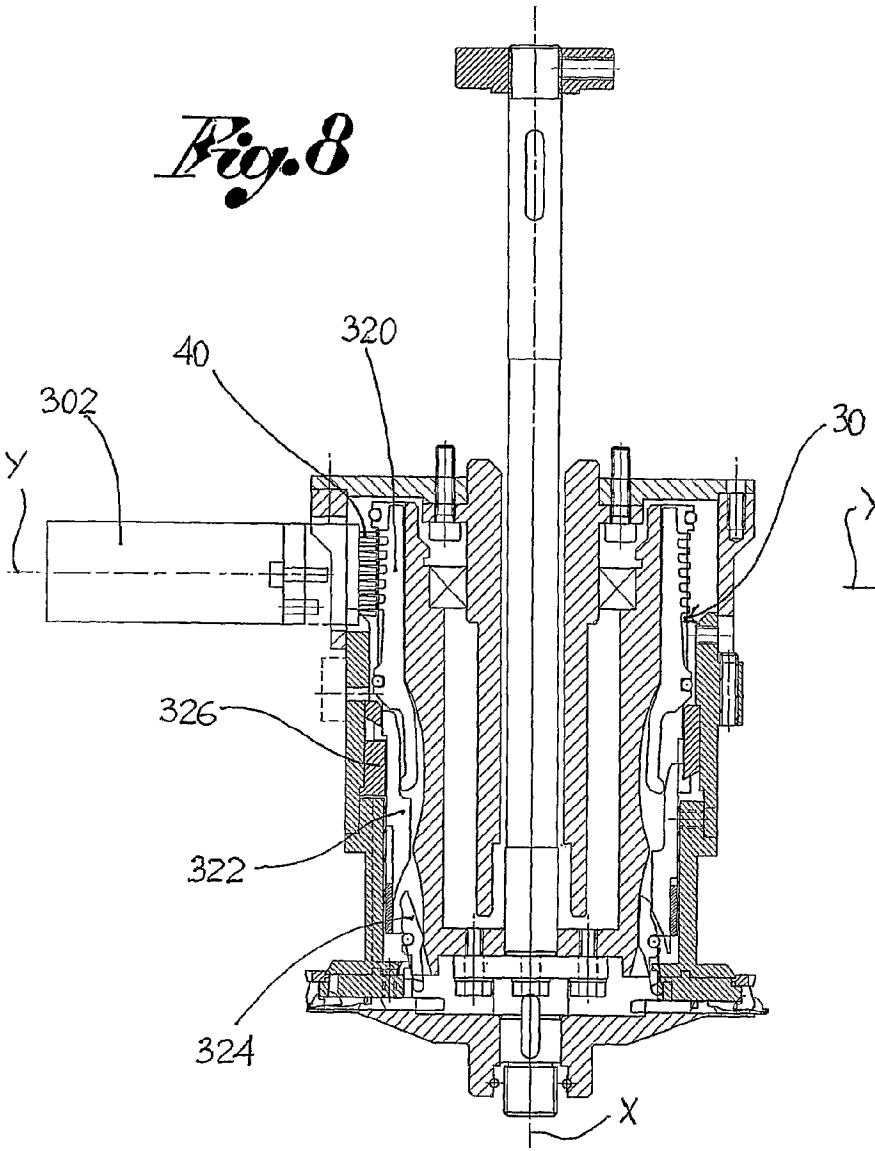

Such variation is like the description for the variation in FIG. 8, but the final section 324 is hinged to the intermediate section in such a way as to ensure a better return of the oscillation, inasmuch as mechanically forced.

Figure 10:
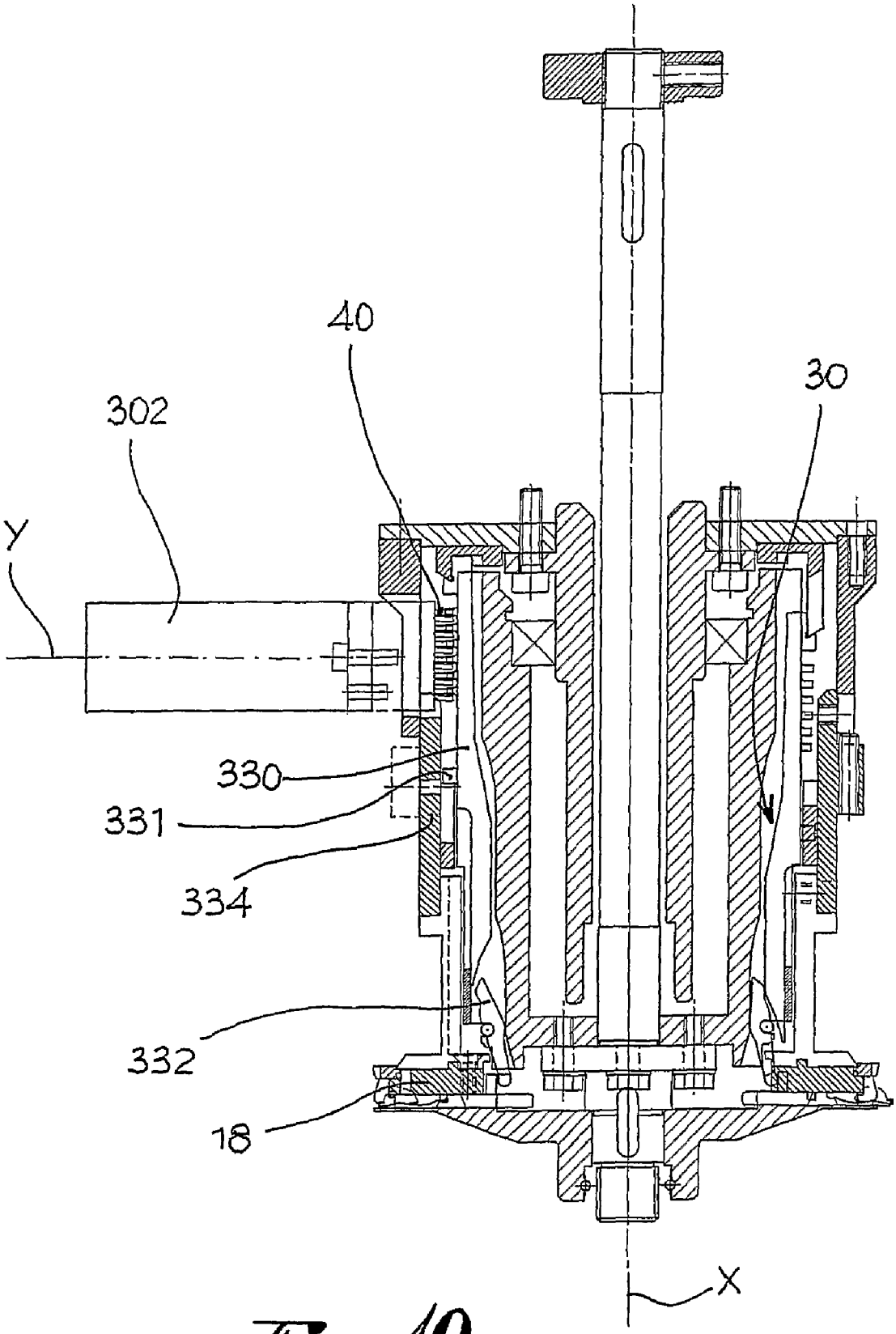

According to yet a further embodiment variation, the selector rod 30 is composed of two separate sections with a mainly axial extension (FIG. 10).

The selector rod 30 comprises a main section 330 sliding axially between an upper position, in which it can be engaged by the actuator levers 40 of the actuator 302, with a horizontal actuation axis, and a lower position.

The main section 330 comprises a protruding notch 331.

The selector rod 30 also comprises a final spring-hinged section 332 able to engage of the desired dial needle 18 for oscillation.

In addition, the selectors comprise a selector cam 334 able to engage the notch 331 of the main section 330 of the selector rod 30.

Depending on the actuator command, the main section 330 shifts and the notch 331 takes up a position in which it can be engaged by the selector cam 334.

By rotating, the selector cam 334 acts on the main section 330, making it lower sufficiently to act on the final section 332 which, oscillating, moves the selected dial needle 18.

Figure 11B:
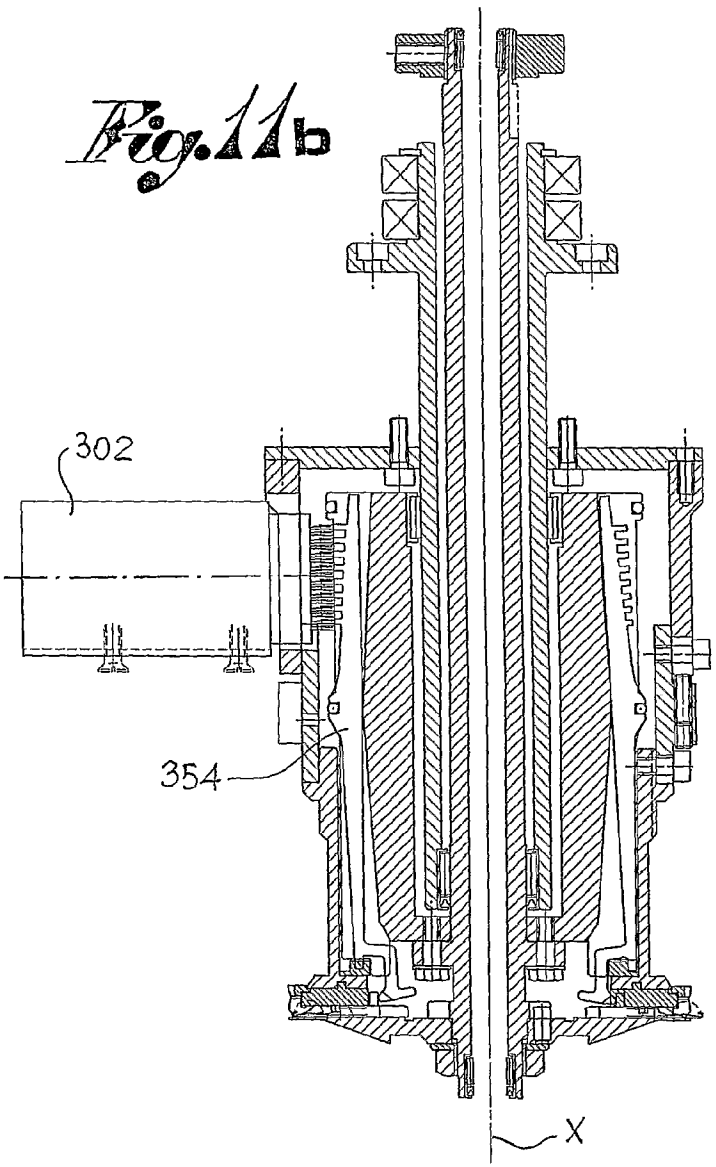
Figure 11A:
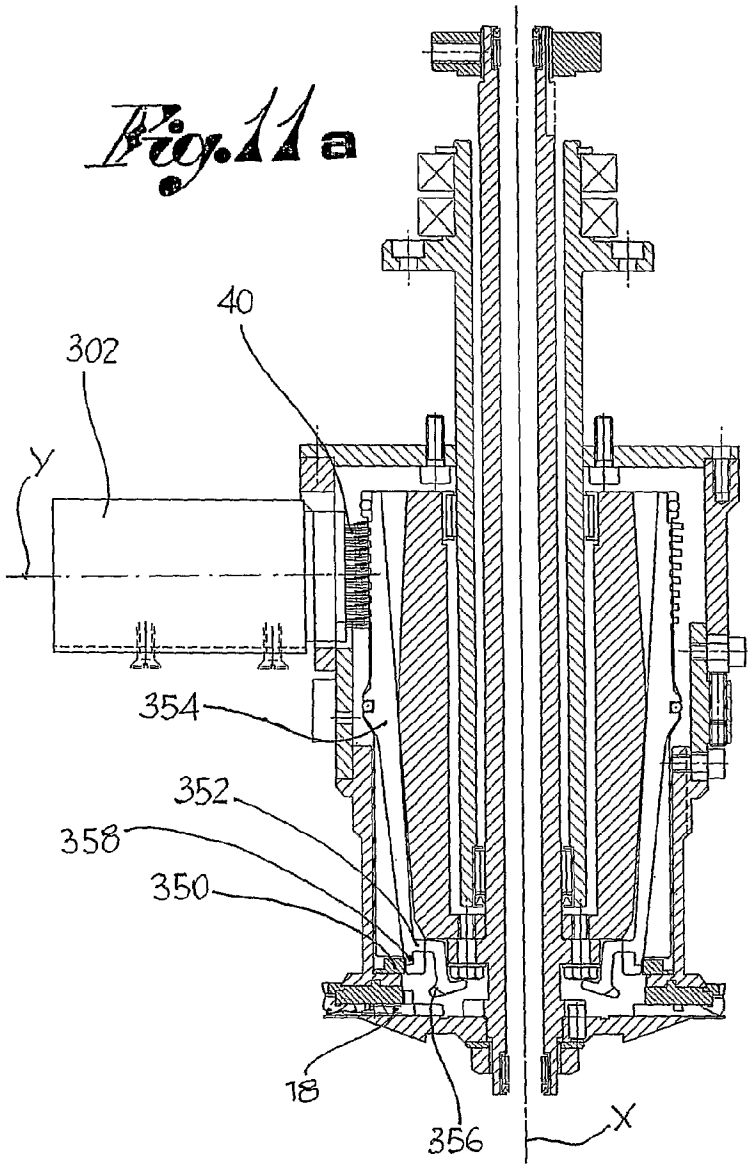

According to yet a further embodiment variation, the selectors comprise selector rods 30 in a single piece and a selector cam 350 positioned in proximity to the dial (FIGS. 11*a* and 11*b*).

The selector rod 30 comprises a foot 352 at the lower extremity and a long spring-hinged section 354.

The long section 354 co-operates with the upper extremity with the actuator levers 40 of the actuator 302, on a horizontal actuation axis. At the other extremity, the long section 354 is connected to the foot 352, which protrudes from the long section, receding radially inwards.

The foot 352, hammer-shaped, comprises a nose 356 able to act on the dial needle 18.

Furthermore, the foot 352, for example at the connection with the long section 354, has a notch 358 able to engage, for the oscillation of the selector rod 30, with the selector cam 350.

Depending on the actuator command 302, some selector rods perform a first oscillation, so that the notch 358 takes up a suitable position for being engaged by the selector cam 350, while the nose 356 is still distanced from the dial needle inasmuch as radially rearward in relation to the notch.

By rotating the selector cam 350 engages the notch and drags it in a second oscillation, forced by the cam, in a direction concordant with the previous so that the nose 356 acts on the desired dial needle.

In other words the oscillation lever performs a double oscillation: the first activated by the actuator 302, the second by the selector cam.

The notch 358 is proximal to the nose 356 and distal to the engagement zone with the actuator levers 40, to limit the deformation of the foot 352 when it acts on the dial needle.

Advantageously, when the selector rod acts on the dial needle, the selector cam 350 abuts radially to the movement made by the needle and such movement is therefore not transmitted to the long section 354 of the selector rod and to the actuator levers 40.

Advantageously, the machine makes it possible to limit or overcome drawbacks or flaws in the formation of the stitch.

It is clear that a person skilled in the art may make modifications to the machine described above so as to satisfy contingent and specific requirements, all moreover contained within the scope of protection as defined by the appended claims.

The invention claimed is:

1. A circular knitting machine for the production of men's socks, comprising:

a cylinder having a rotation axis, rotating in a controllable manner around said axis, and having a plurality of axial grooves on the external surface;

a plurality of cylinder needles, held so that they can slide along said axial grooves of the cylinder;

a mechanism for moving the cylinder needles, able to impose a translation in alternate directions on the cylinder needles between a lower limit position and an upper limit position, axially higher than the lower limit position;

a fixed external crown, which surrounds the cylinder, coaxial with it, fitted with a plurality of crown grooves;

a plurality of sinkers, held so as to be able to slide along said crown grooves;

a mechanism for moving the sinkers, able to impose a translation in alternate directions on the sinkers between a rearward limit position and a forward limit position, radially internal to the rearward limit position;

a dial, positioned in such a way as to surmount the cylinder, coaxial with it, rotating on command around the rotation axis of the cylinder, fitted with a plurality of radial grooves, extending radially inside the outer surface of the cylinder;

a dial shaft, connected to the dial to drag it in rotation;

a plurality of dial needles, held so that they can slide along said radial grooves of the dial;

a mechanism for moving the dial needles, which can engage with said dial needles and able to impose translation in alternate directions on the dial needles, between a rearward limit position and a forward limit position, radially external to the rearward limit position;

at least one yarn-finger able to feed at least one yarn for the creation of the sock; wherein the cylinder needles, dial needles and sinkers co-operate to interlace the yarn and form the stitches which compose the sock;

a dial needles selector mechanism, able to selectively move the dial needles to translate them from a disengaged position to an engaged position, in which they can be engaged by said mechanism for moving the dial needles, involving the selected needles in the formation of the stitches and excluding the non-selected needles;

a mechanical traction mechanism able to exert a pulling effect on the sock being formed by means of mechanical gripping of the sock being formed, the mechanism comprising:

a suction tube inside the cylinder, rotating jointly with it;

a tubular bush, inside the suction tube, rotating jointly with it, axially translatable in it;

a mechanism for moving the bush axially; and a gripping device, translatable to the inside of the suction tube inside the bush, able to be commanded so as to form releasable gripping elements so as to drag at least a portion of the sock being formed against the bush, to pinch it mechanically;

wherein the mechanism comprises a spindle inside the dial shaft, sliding axially, connected to the gripping device.

2. A machine according to claim 1, wherein the selector mechanism comprises a plurality of selector rods oscillating on command, which can engage with the dial needles to select at least some of them.

3. A machine according to claim 2, wherein the selector mechanism comprises a selection command mechanism able to selectively move at least some of the selection rods, to select the dial needles.

4. A machine according to claim 3, wherein the selection command mechanism comprises a plurality of actuator levers which can be selectively commanded to protrude thus moving at least one of the selector rods.

5. A machine according to claim 4, wherein the selector rods comprise an engagement section, terminating in an engagement extremity which can be engaged with at least one of the dial needles, and a command section, connected to the engagement section extending so as that it can be engaged by at least one of the actuator levers.

6. A machine according to claim 5, wherein the command section of each selector rod comprises a boss projecting externally in relation to the rotation axis of the cylinder, wherein the bosses of the selector rods are reciprocally staggered, and wherein the actuator levers are reciprocally staggered and corresponding to the bosses, to allow an actuator lever to engage with only some of the selection rods.

7. A machine according to claim 6, wherein the bosses are reciprocally axially staggered, as are the actuator levers.

8. A machine according to claim 1, wherein the dial needles comprise a machining section for the creation of the stitch and a moving section, which can engage with the mechanism for moving the dial needles; and wherein the moving sections of the dial needles are axially staggered.

9. A machine according to claim 8, wherein the moving sections are positioned at two different heights.

10. A machine according to claim 1, wherein the number of cylinder needles is the same as the number of dial needles.

11. A machine according to claim 1, comprising an uptwister, positioned so as to surmount the dial, coaxial with the rotation axis; and wherein the mechanism for moving the dial needles comprises a plurality of cams, said cams being housed on said uptwister, between the uptwister and the dial.

12. A machine according to claim 11, comprising, in addition, a cutting device, positioned on the uptwister, able to cut the yarn.

13. A machine according to claim 1, wherein the cylinder needles comprise a) a spindle extending mainly along the rotation axis, between a lower extremity which can be made to slide by the mechanism for moving the cylinder needles, and an upper extremity, which can engage with the dial needles and the sinkers to form the stitch;

b) a hook and a tab, at the upper extremity of the spindle, said tab being pivoted at the spindle at a hinging point, so as to be reclosable onto said hook to form the space for the yarn; and c) a transfer boss, projecting externally from the spindle, positioned below the hinging point, able to engage a stitch formed in the movement between the lower limit position and the upper limit position;

wherein the transfer boss is positioned along the spindle in such a way that, in the upper limit position of the cylinder needle, said transfer boss is above the machining extremity of the dial needle, to enable the transfer of the stitch from the cylinder to the dial.

14. A machine according to claim 13, wherein the cylinder needle has a first heel at the lower extremity of the spindle and a second heel between the first heel and the transfer boss, able to be engaged by said mechanism for moving the cylinder needles so as to bring the cylinder needle to the upper limit position.

15. A machine according to claim 1, wherein said mechanism for moving the cylinder needles comprises at least one jack, positioned in the relative cylinder groove, below the cylinder needle.

16. A machine according to claim 15, comprising a drum, coaxial to the cylinder and situated radially outside it, wherein the mechanism for moving the cylinder needles comprises two jacks, positioned in the same cylinder groove, one below the other, and wherein the mechanism for moving the cylinder needles comprises a plurality of cam units, joined to the drum, wherein a first unit can engage the cylinder needles for translation, and the further units can engage the respective jacks for translation.

17. A machine according to claim 13, wherein the mechanism for moving the cylinder needles comprises at least one cam sufficiently steep to bring the cylinder needle to the upper limit position so that the transfer boss is above the machining extremity of the dial needle.

18. A machine according to claim 1, wherein the cylinder is hollow inside, and the machine comprises a suction traction mechanism able to produce a flow of air aspirated from the upper extremity of the cylinder to the bottom of it, to suck down the sock being formed.

19. A machine according to claim 1, wherein the spindle is perforated axially to form an air supply channel for the supply of pressurized air to the gripping device.

20. A machine according to claim 1, wherein the gripping device turns jointly with the spindle.

21. A machine according to claim 1, wherein the gripping device comprises a flexible, inflatable wall to create said gripping element.

22. A machine according to claim 1, wherein the gripping device comprises a plurality of mobile pistons to create said gripping elements.

23. A machine according to claim 1, wherein the suction traction mechanism and the mechanical traction mechanism are operatively connected to achieve synchronized functioning.

24. A machine according to claim 2, wherein the selector mechanism comprises a selector cam able to engage at least a section of the selector rod to create an abutment which opposes the action between the dial needle and said section of the selector rod engaged with the cam.

25. A machine according to claim 24, wherein the selector rods are a single piece and the selector cam is positioned near the dial.

26. A machine according to claim 25, wherein the selector rod comprises a foot at the lower extremity and a long section, spring-hinged, wherein the long section cooperates at its upper extremity with the actuator levers of the actuator and at the other extremity is connected to the foot, which protrudes from the long section receding radially inwards.

27. A machine according to claim 26, wherein the foot comprises a nose able to act on the dial needle and a notch able to engage, for oscillation of the selector rod, with the selector cam, wherein the notch is proximal to the nose and distal from area of engagement with the actuator levers.

28. A machine according to claim 24, wherein the selector rods are able to complete a first oscillation, forced by the actuator, so that the notch assumes a suitable position for engagement with the selector cam, while the nose is distanced from the dial needle, and a second oscillation, forced by the cam, in a direction concordant with the previous, such that the nose acts on the dial needle.

* * * * *